US010042292B2

(12) United States Patent
Ochi et al.

(10) Patent No.: US 10,042,292 B2
(45) Date of Patent: Aug. 7, 2018

(54) IMAGE FORMING APPARATUS AND IMAGE FORMING METHOD FOR MEASURING ELECTRICAL RESISTANCE VALUE OF RECORDING MEDIUM

(71) Applicant: FUJI XEROX CO., LTD., Tokyo (JP)

(72) Inventors: Takashi Ochi, Kanagawa (JP); Hisashi Murase, Kanagawa (JP); Yuki Yokoyama, Kanagawa (JP); Takashi Ohashi, Kanagawa (JP); Keitaro Mori, Kanagawa (JP); Masahiko Fujita, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/347,276

(22) Filed: Nov. 9, 2016

(65) Prior Publication Data

US 2017/0357193 A1 Dec. 14, 2017

(30) Foreign Application Priority Data

Jun. 8, 2016 (JP) ..... 2016-114529

(51) Int. Cl.
*G03G 15/16* (2006.01)
*G03G 15/00* (2006.01)

(52) U.S. Cl.
CPC ..... *G03G 15/1665* (2013.01); *G03G 15/5029* (2013.01)

(58) Field of Classification Search
CPC ..... G03G 15/1665; G03G 15/1675; G03G 15/5029
See application file for complete search history.

(56) References Cited

U.S. PATENT DOCUMENTS

2010/0074641 A1* 3/2010 Takenaka ..... G03G 15/161 399/66

FOREIGN PATENT DOCUMENTS

JP 2013-097146 A 5/2013

* cited by examiner

*Primary Examiner* — Hoang Ngo
(74) *Attorney, Agent, or Firm* — Sughrue Mion, PLLC

(57) ABSTRACT

An image forming apparatus includes a transfer unit and a pair of measuring units. The transfer unit transfers an image onto at least one recording medium by applying a voltage between the at least one recording medium and the image along a thickness direction of the at least one recording medium. Before the transfer unit applies the voltage, the pair of measuring units measure respective electrical resistance values of a front surface and a rear surface of the at least one recording medium in a direction crossing the thickness direction.

18 Claims, 5 Drawing Sheets

IMAGE FORMING APPARATUS AND IMAGE FORMING METHOD FOR MEASURING ELECTRICAL RESISTANCE VALUE OF RECORDING MEDIUM

CROSS-REFERENCE TO RELATED APPLICATIONS

This application is based on and claims priority under 35 USC 119 from Japanese Patent Application No. 2016-114529 filed Jun. 8, 2016.

BACKGROUND

Technical Field

The present invention relates to an image forming apparatus and an image forming method for measuring the electrical resistance value of a recording medium.

SUMMARY

According to an aspect of the invention, there is provided an image forming apparatus including a transfer unit and a pair of measuring units. The transfer unit transfers an image onto at least one recording medium by applying a voltage between the at least one recording medium and the image along a thickness direction of the at least one recording medium. Before the transfer unit applies the voltage, the pair of measuring units measure respective electrical resistance values of a front surface and a rear surface of the at least one recording medium in a direction crossing the thickness direction.

BRIEF DESCRIPTION OF THE DRAWINGS

Exemplary embodiments of the present invention will be described in detail based on the following figures, wherein.

DETAILED DESCRIPTION

Figure 1:
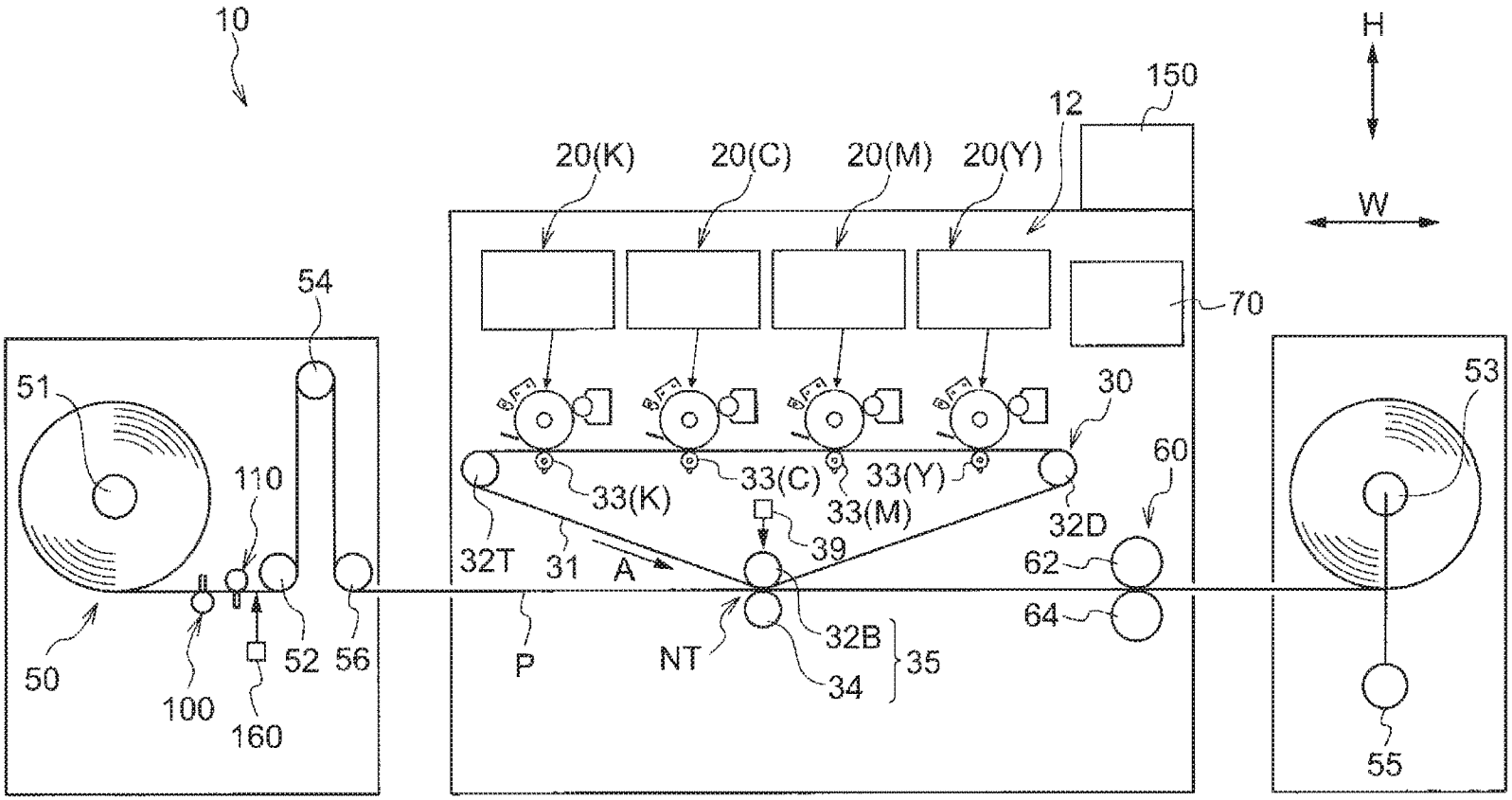
FIG. 1 is a schematic diagram illustrating a configuration of an image forming apparatus according to a first exemplary embodiment.

Examples of exemplary embodiments according to the present invention will be described below based on the drawings. Arrows H and W indicated in the drawings denote the vertical direction and the horizontal direction corresponding to an apparatus width direction, respectively.

First Exemplary Embodiment

Image Forming Apparatus 10

A configuration of an image forming apparatus 10 will first be described. FIG. 1 illustrates the configuration of the image forming apparatus 10 as viewed from a front side thereof.

The image forming apparatus 10 is an apparatus that transports a continuous sheet P, which is previously disposed on a transport path, in a predetermined transport direction (hereinafter referred to as the sheet transport direction) and forms an image on the continuous sheet P. That is, the continuous sheet P as an object on which the image is formed by the image forming apparatus 10 is an example of a recording medium that is transported after previously being disposed on the transport path. The continuous sheet P has a length along the sheet transport direction.

Further, for example, the continuous sheet P has a front surface serving as an image surface on which the image is formed and a rear surface serving as a non-image surface on which the image is not formed. For example, plain paper, a resin film, a metal foil (such as an aluminum foil, for example), or a recording medium formed of a resin film and a metal foil stacked upon each other is used as the continuous sheet P. The recording medium formed of a resin film and a metal foil stacked upon each other may have the metal foil on one of the image surface and the non-image surface and the resin film on the other one of the image surface and the non-image surface. In this recording medium, for example, the electrical resistance value is lower on the one of the image surface and the non-image surface having the metal foil than on the other one of the image surface and the non-image surface having the resin film.

As illustrated in FIG. 1, the image forming apparatus 10 specifically includes a transport unit 50, an image forming unit 12, a fixing device 60, a controller 70, a pair of measuring units 100 and 110, a display 150, and a detecting unit 160.

Transport Unit 50

The transport unit 50 is a part having a function of transporting the continuous sheet P previously disposed on the transport path. As illustrated in FIG. 1, the transport unit 50 specifically includes a reel-out roller 51 (an example of a supply unit), a reel-in roller 53, a driving unit 55, and winding rollers 52, 54, and 56 (examples of a winding member).

The reel-out roller 51 is a roller that reels out the continuous sheet P, and functions as an example of the supply unit that supplies the continuous sheet P to a later-described transfer unit 35 (a second transfer position NT). A trailing end portion (an upstream portion in the sheet transport direction) of the continuous sheet P is wound around the reel-out roller 51. The reel-in roller 53 is a roller that reels in the continuous sheet P, and functions as a collecting unit that collects the continuous sheet P transported from the later-described transfer unit 35 (the second transfer position NT). A leading end portion (a downstream portion in the sheet transport direction) of the continuous sheet P is wound around the reel-in roller 53.

The driving unit 55 drives the reel-in roller 53 to rotate in a direction in which the reel-in roller 53 reels in the continuous sheet P (the counterclockwise direction in FIG. 1). Further, the reel-in roller 53 driven to rotate by the driving unit 55 reels in the continuous sheet P, thereby drawing the continuous sheet P and causing the reel-out roller 51 to reel out the continuous sheet P. Driven to rotate by the driving unit 55, the reel-in roller 53 thus reels in the continuous sheet P, and the reel-out roller 51 reels out the continuous sheet P, to thereby transport the continuous sheet P in the sheet transport direction.

The winding rollers 52, 54, and 56 are disposed in this order along the sheet transport direction on the transport path between the reel-out roller 51 and the later-described transfer unit 35 (the second transfer position NT). Among the winding rollers 52, 54, and 56, therefore, the winding roller 52 is disposed at a position closest to the reel-out roller 51. Further, the winding roller 54 is disposed above the winding rollers 52 and 56. The winding rollers 52 and 56 have the continuous sheet P wound therearound such that the respective outer circumferential surfaces thereof contact the image surface of the continuous sheet P. The winding roller 54 has the continuous sheet P wound therearound such that the outer circumferential surface thereof contacts the non-image surface of the continuous sheet P.

Image Forming Unit 12

The image forming unit 12 is a part having a function of forming the image on the continuous sheet P with an electrophotographic system. The image forming unit 12 specifically includes toner image forming units 20 that form toner images and a transfer device 30 that transfers the toner images formed by the toner image forming units 20 onto the continuous sheet P.

The plural toner image forming units 20 are provided to form the toner images for respective colors. In this exemplary embodiment, the toner image forming units 20 are provided for a total of four colors: yellow (Y), magenta (M), cyan (C), and black (K). Letters (Y), (M), (C), and (K) indicated in FIG. 1 denote components corresponding to the above-described respective colors.

Toner Image Forming Units 20

Figure 2:
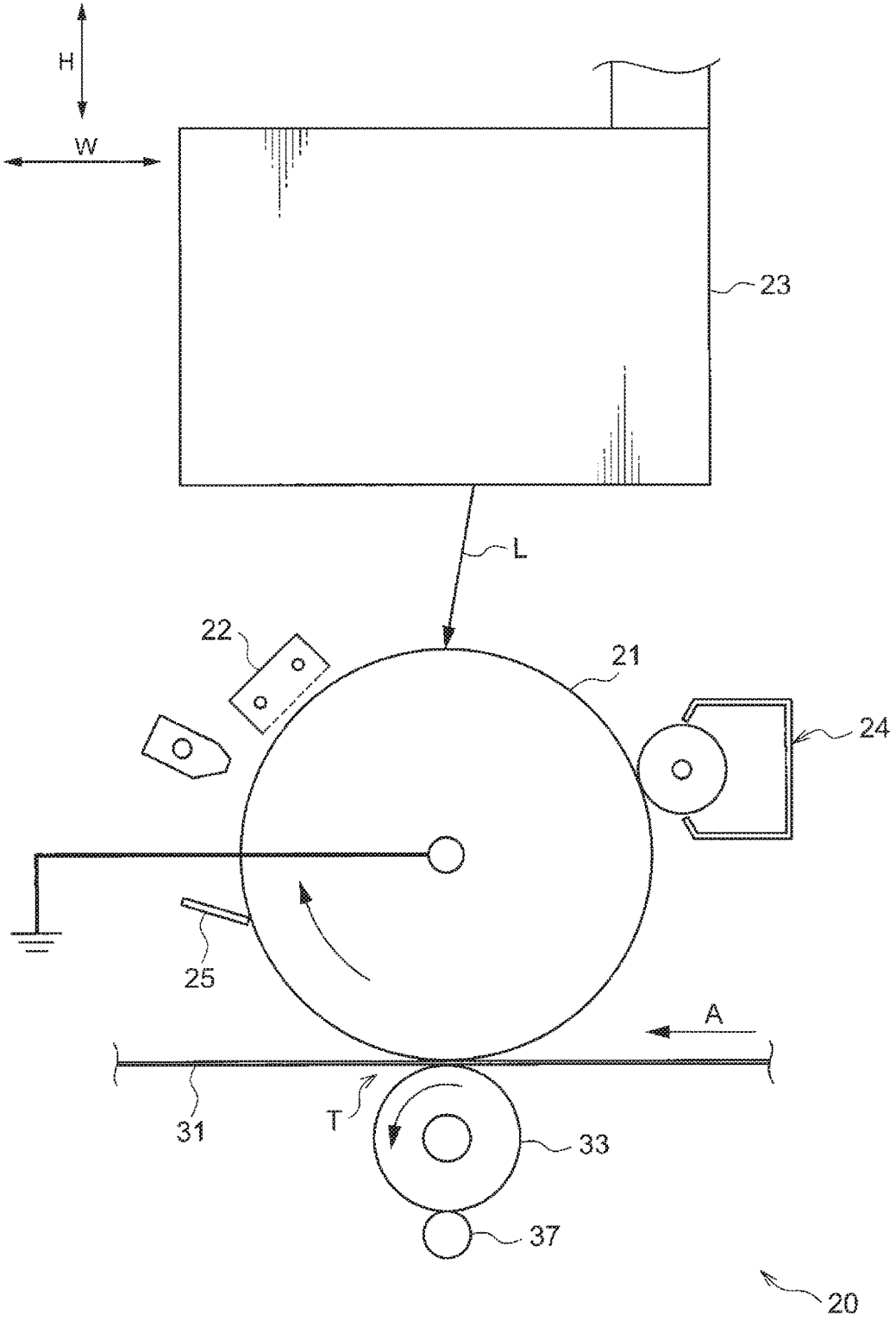
FIG. 2 is a schematic diagram illustrating a configuration of a toner image forming unit according to the first exemplary embodiment.

The toner image forming units 20 for the respective colors are basically configured similarly except for toners used therein. As illustrated in FIG. 2, each of the toner image forming units 20 for the respective colors specifically includes a photoconductor drum 21 (a photoconductor) that rotates in the clockwise direction in FIG. 2, a charger 22 that charges the photoconductor drum 21, and an exposure device 23 that exposes the photoconductor drum 21 charged by the charger 22 to form an electrostatic latent image on the photoconductor drum 21. Each of the toner image forming units 20 for the respective colors further includes a developing device 24 that develops the electrostatic latent image formed on the photoconductor drum 21 by the exposure device 23 to form a toner image and a blade 25 serving as a remover that removes toner remaining on a surface of the photoconductor drum 21 after the transfer of the toner image to a later-described transfer belt 31.

The charger 22 charges the surface (a photosensitive layer) of the photoconductor drum 21 to negative polarity, for example. In the surface of the photoconductor drum 21 charged to negative polarity, a portion irradiated with exposure light L by the exposure device 23 exhibits positive polarity, forming the electrostatic latent image on the surface of the photoconductor drum 21. Then, the toner frictionally charged to negative polarity in the developing device 24 adheres to the electrostatic latent image exhibiting positive polarity, thereby developing the electrostatic latent image. The toner image is thus formed on the surface (outer circumferential surface) of the photoconductor drum 21. The blade 25 contacts the surface of the photoconductor drum 21 and scrapes off the toner remaining on the surface of the photoconductor drum 21.

Transfer Device 30

The transfer device 30 superimposes and first-transfers the toner images on the photoconductor drums 21 for the respective colors onto the transfer belt 31 (an intermediate transfer body), and second-transfers the superimposed toner images onto the continuous sheet P at the second transfer position NT (a nip part). As illustrated in FIG. 1, the transfer device 30 specifically includes the transfer belt 31, first transfer rollers 33, and a second transfer roller 34.

Transfer Belt 31

As illustrated in FIG. 1, the transfer belt 31 has an endless shape, and the posture of the transfer belt 31 is determined by plural rollers 32 around which the transfer belt 31 is wound. In this exemplary embodiment, the transfer belt 31 has the posture of an inverted obtuse triangle extending in the apparatus width direction in a front view. Among the plural rollers 32, a roller 32D illustrated in FIG. 1 functions as a driving roller that rotates the transfer belt 31 in the direction of arrow A with drive force of a not-illustrated motor. The transfer belt 31 rotates in the direction of arrow A to thereby transport the first-transferred images to the second transfer position NT.

Further, among the plural rollers 32, a roller 32T illustrated in FIG. 1 functions as a tension providing roller that provides tension to the transfer belt 31. Among the plural rollers 32, a roller 32B illustrated in FIG. 1 functions as a facing roller facing the second transfer roller 34. As described above, an obtuse lower-end apical portion of the transfer belt 31 having the posture of an inverted obtuse triangle is wound around the facing roller 32B. An upper side portion of the transfer belt 31 extending in the apparatus width direction in the above-described posture contacts the photoconductor drums 21 for the respective colors from below.

First Transfer Rollers 33

The first transfer rollers 33 are rollers that transfer the toner images on the respective photoconductor drums 21 onto the transfer belt 31, and are disposed inside the transfer belt 31, as illustrated in FIG. 1. Each of the first transfer rollers 33 is disposed to face the photoconductor drum 21 of the corresponding color via the transfer belt 31. Further, a first transfer voltage is applied between the first transfer roller 33 and the photoconductor drum 21 by a power supply unit 37 (see FIG. 2). Thereby, the toner image formed on the photoconductor drum 21 is transferred onto the transfer belt 31 at a first transfer position T between the photoconductor drum 21 and the first transfer roller 33.

Second Transfer Roller 34

The second transfer roller 34 is a roller that transfers the toner images superimposed on the transfer belt 31 onto the continuous sheet P. As illustrated in FIG. 1, the second transfer roller 34 is disposed with the transfer belt 31 interposed between the second transfer roller 34 and the facing roller 32B. The second transfer roller 34 and the transfer belt 31 are in contact with each other under a predetermined load. The second transfer position NT (the nip part) is formed between the second transfer roller 34 and the transfer belt 31 thus in contact with each other. The continuous sheet P is supplied to the second transfer position NT from the reel-out roller 51. The second transfer roller 34 is driven to rotate in the clockwise direction in FIG. 1.

Further, a second transfer voltage is applied between the second transfer roller 34 and the facing roller 32B by a voltage applying unit 39. Thereby, a potential difference is caused between the toner images transferred to the transfer belt 31 and the continuous sheet P transported to the second transfer position NT. That is, at the second transfer position NT, the voltage is applied between the continuous sheet P and the toner images along the thickness direction of the continuous sheet P. Thereby, electrostatic force acts on the toner images on the transfer belt 31, transferring the toner images from the transfer belt 31 onto the continuous sheet P passing the second transfer position NT. As described above, in the present exemplary embodiment, the transfer unit 35 is configured which transfers the toner images onto the continuous sheet P by applying the voltage between the continuous sheet P and the toner images along the thickness direction of the continuous sheet P with the second transfer roller 34 and the facing roller 32B.

Fixing Device 60

As illustrated in FIG. 1, the fixing device 60 is disposed downstream of the second transfer position NT in the sheet transport direction. The fixing device 60 specifically includes a heating roller 62 and a pressure roller 64. In the fixing device 60, the toner images transferred to the continuous sheet P are fixed on the continuous sheet P with heat and pressure applied thereto by the heating roller 62 and the pressure roller 64.

Pair of Measuring Units 100 and 110

As illustrated in FIG. 1, the pair of measuring units 100 and 110 are disposed between the reel-out roller 51 and the winding roller 52 (an example of the winding member) on the transport path between the reel-out roller 51 and the transfer unit 35 (the second transfer position NT).

Figure 3:
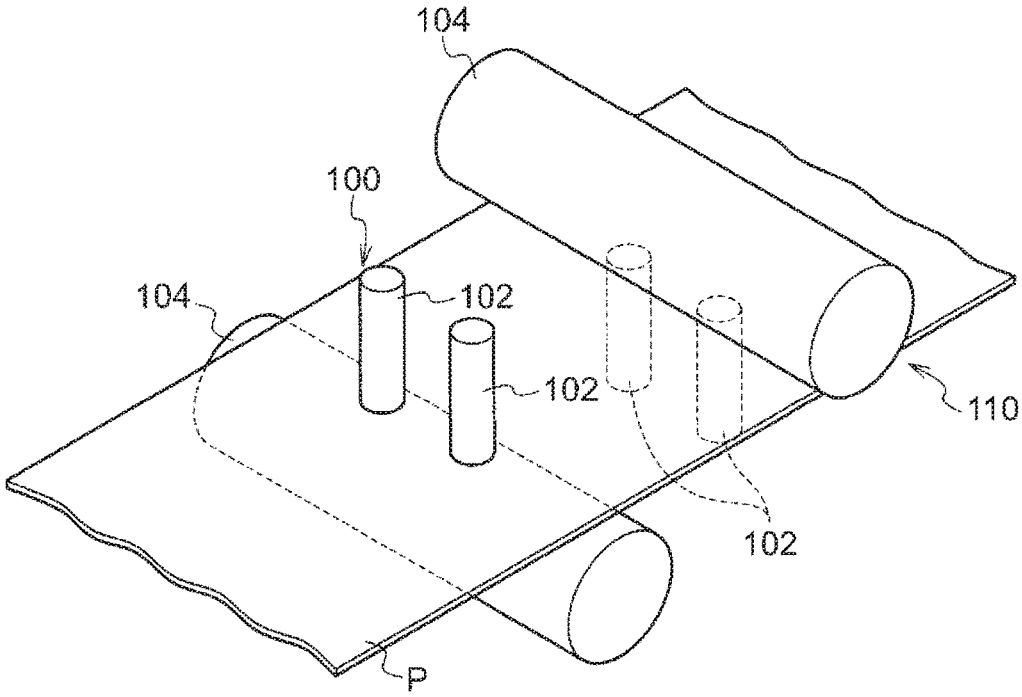
FIG. 3 is a schematic diagram illustrating a configuration of measuring units according to the first exemplary embodiment.

The measuring unit 100 is a measuring unit that measures the electrical resistance value of the image surface of the continuous sheet P in a direction crossing the thickness direction of the continuous sheet P before the voltage application by the transfer unit 35. As illustrated in FIG. 3, the measuring unit 100 specifically includes a pair of terminals 102 and a facing roller 104. The pair of terminals 102 are disposed on the upper side of the transport path of the continuous sheet P along the width direction of the continuous sheet P. The pair of terminals 102 are configured to contact and separate from the image surface of the continuous sheet P.

The facing roller 104 is disposed below the pair of terminals 102 on the lower side of the transport path of the continuous sheet P. That is, the facing roller 104 is disposed to face the pair of terminals 102 via the continuous sheet P. The facing roller 104 is in contact with the non-image surface of the continuous sheet P, and is rotated by the movement of the transported continuous sheet P. The facing roller 104 further holds the continuous sheet P with the pair of terminals 102, when the pair of terminals 102 contact the continuous sheet P.

A pressing pressure applied to the continuous sheet P when the pair of terminals 102 contact the continuous sheet P is set to range from 0.049 MPa (0.5 kgf/cm$^2$) to 0.294 MPa (3.0 kgf/cm$^2$), for example. If the pressing pressure falls below 0.049 MPa, the terminals 102 may fail to trace irregularities of the continuous sheet P and separate from the continuous sheet P. If the pressing pressure exceeds 0.294 MPa, the continuous sheet P may deform.

For example, the measuring unit 100 applies a voltage of a predetermined value between the pair of terminals 102 contacting the image surface of the continuous sheet P, and detects the value of a current flowing between the pair of terminals 102 in this case. Then, based on the applied voltage value and the detected current value, the measuring unit 100 measures the electrical resistance value of the image surface of the continuous sheet P in the direction crossing the thickness direction of the continuous sheet P.

The measuring unit 110 is a measuring unit that measures the electrical resistance value of the non-image surface of the continuous sheet P in the direction crossing the thickness direction of the continuous sheet P. Similarly to the measuring unit 100, the measuring unit 110 also includes the pair of terminals 102 and the facing roller 104. The measuring unit 110 is configured similarly to the measuring unit 100 except for being vertically inverted relative to the measuring unit 100.

For example, the measuring unit 110 also applies a voltage of a predetermined value between the pair of terminals 102 contacting the non-image surface of the continuous sheet P, and detects the value of a current flowing between the pair of terminals 102 in this case. Then, based on the applied voltage value and the detected current value, the measuring unit 110 measures the electrical resistance value of the non-image surface of the continuous sheet P in the direction crossing the thickness direction of the continuous sheet P.

Further, in the present exemplary embodiment, the measuring units 100 and 110 are configured to measure the respective electrical resistance values of the image surface and the non-image surface of the continuous sheet P at different times. For example, with the pair of terminals 102 of the measuring unit 110 separated from the continuous sheet P, the measuring unit 100 measures the electrical resistance value of the image surface of the continuous sheet P in the direction crossing the thickness direction of the continuous sheet P with the pair of terminals 102 of the measuring unit 100 kept in contact with the image surface. Thereafter, with the pair of terminals 102 of the measuring unit 100 separated from the continuous sheet P, the measuring unit 110 measures the electrical resistance value of the non-image surface of the continuous sheet P in the direction crossing the thickness direction of the continuous sheet P with the pair of terminals 102 of the measuring unit 110 kept in contact with the non-image surface.

Display 150

The display 150 illustrated in FIG. 1 has a function of displaying an item to be notified to a user of the image forming apparatus 10. The display 150 displays a warning to the user and an operating state of the image forming apparatus 10, for example.

Detecting Unit 160

The detecting unit 160 has a function of detecting a disposed state in which the continuous sheet P is disposed on the transport path, and maintaining a detected state in which the disposed state is detected. As illustrated in FIG. 1, the detecting unit 160 is disposed between the reel-out roller 51 and the winding roller 52, for example. An optical sensor or a switch that turns on by contact with the continuous sheet P, for example, is used as the detecting unit 160.

For example, if an optical sensor is used as the detecting unit 160, the detecting unit 160 radiates light onto the transport path, and detects the disposed state of the continuous sheet P disposed on the transport path when the light is blocked by the continuous sheet P disposed on the transport path. The detecting unit 160 further continuously radiates the light from the optical sensor to maintain the detected state in which the disposed state of the continuous sheet P is detected.

Controller 70

The controller 70 is a part having a function of controlling operations of respective units of the image forming apparatus 10. The controller 70 is connected to the pair of measuring units 100 and 110. Thereby, measurement results of the pair of measuring units 100 and 110 are transmitted to the controller 70 from the pair of measuring units 100 and 110. The controller 70 is further connected to the detecting unit 160. Thereby, a detection result of the detecting unit 160 is transmitted to the controller 70 from the detecting unit 160.

The controller 70 is connected to the respective units of the image forming apparatus 10 including the voltage applying unit 39 and the display 150. Based on the detection result of the detecting unit 160 and the measurement results of the pair of measuring units 100 and 110, the controller 70 controls the operations of the respective units of the image forming apparatus 10 including the voltage applying unit 39 and the display 150. The operations of the respective units controlled by the controller 70 will be described in a subsequent description of operations.

Operations

In the present exemplary embodiment, the continuous sheet P is first previously disposed on the transport path of the image forming apparatus 10 by, for example, manual work of the user of the image forming apparatus 10. For example, the continuous sheet P is reeled out of the reel-out roller 51 and disposed from the reel-out roller 51 to the reel-in roller 53 along the transport path.

Then, if the image forming apparatus 10 is powered on, the detecting unit 160 detects the disposed state of the continuous sheet P disposed on the transport path. After the detecting unit 160 detects the disposed state and before an image forming operation is executed, the pair of measuring units 100 and 110 measure the respective electrical resistance values of the image surface and the non-image surface of the continuous sheet P in the direction crossing the thickness direction of the continuous sheet P. That is, the respective electrical resistance values of the image surface and the non-image surface of the continuous sheet P are measured before the transfer unit 35 applies the voltage between the continuous sheet P and the toner images. In this process, the measuring units 100 and 110 measure the respective electrical resistance values of the image surface and the non-image surface of the continuous sheet P at different times.

If at least one of the electrical resistance values measured on the image surface and the non-image surface of the continuous sheet P is equal to or lower than a predetermined reference resistance value, the controller 70 controls the operations of the respective units as follows. That is, the display 150 displays a warning that the set continuous sheet P is exempt from quality warranty, for example. The warning to be displayed may be a message that an image defect may occur or a message prompting replacement of the continuous sheet P, for example.

In place of or in addition to the above-described display of the warning, the transfer operation of the transfer device 30 (the voltage applying operation of the voltage applying unit 39) or the operation of the entire image forming apparatus 10 including the transport unit 50, the image forming unit 12, and the fixing device 60 may be prevented from being executed. Further, the display of the warning and the suspension of the operation described above may be replaced by a configuration that reduces the value of the voltage to be applied by the voltage applying unit 39.

If any of the electrical resistance values measured on the image surface and the non-image surface of the continuous sheet P exceeds the predetermined reference resistance value, a start-up operation of the image forming apparatus 10 is performed to make the image forming apparatus 10 capable of executing image formation. Then, after the completion of the measurement by the measuring units 100 and 110, the measurement of the electrical resistance values by the measuring units 100 and 110 is not performed during the detected state of the detecting unit 160 on the assumption that the continuous sheet P subjected to the measurement of the electrical resistance values is continuously being used.

Further, after the completion of the measurement by the measuring units 100 and 110, the measurement of the electrical resistance values by the measuring units 100 and 110 is performed again, if the detecting unit 160 detects, after an interruption of the detected state thereof, the disposed state of the continuous sheet P disposed on the transport path. The detected state of the detecting unit 160 may be interrupted when the continuous sheet P is replaced, the image forming apparatus 10 is powered off, or the image forming apparatus 10 shifts to a standby state (sleep mode) because of not being used for an extended time, for example.

As described above, in the present exemplary embodiment, the pair of measuring units 100 and 110 measure the respective electrical resistance values of the image surface and the non-image surface of the continuous sheet P in the direction crossing the thickness direction of the continuous sheet P before the execution of the image forming operation (before the voltage application by the transfer unit 35).

It is therefore known before the voltage application whether or not the voltage applied by the transfer unit 35 along the thickness direction of the continuous sheet P has an electrical resistance value that may cause a transfer failure due to a current flowing through the image surface and the non-image surface of the continuous sheet P in the direction crossing the thickness direction of the continuous sheet P.

Further, in the present exemplary embodiment, if any of the electrical resistance values measured on the image surface and the non-image surface of the continuous sheet P is equal to or lower than the predetermined reference resistance value, the warning is displayed, and/or the operation of the image forming apparatus 10 is limited. In the image surface and the non-image surface of the continuous sheet P, therefore, a current flow in the direction crossing the thickness direction of the continuous sheet P is suppressed. Thereby, the transfer failure due to, for example, scattering of the toners of the toner images transferred to the continuous sheet P from the transfer belt 31 is suppressed.

Further, in the present exemplary embodiment, the measuring units 100 and 110 measure the respective electrical resistance values of the image surface and the non-image surface of the continuous sheet P at different times. As compared with a configuration in which the measuring units 100 and 110 measure the electrical resistance values at the same time, therefore, the present exemplary embodiment suppresses obstruction of the electrical resistance value measuring operation of one of the measuring units 100 and 110 by the electrical resistance value measuring operation of the other one of the measuring units 100 and 110. Specifically, as compared with the configuration in which the measuring units 100 and 110 measure the electrical resistance values at the same time, the present exemplary embodiment suppresses mixing of the current flowing between the pair of terminals 102 in the measuring unit 100 and the current flowing between the pair of terminals 102 in the measuring unit 110, thereby suppressing measurement errors.

Further, in the present exemplary embodiment, after the completion of the measurement by the measuring units 100 and 110, the measurement of the electrical resistance values by the measuring units 100 and 110 is not performed during the detected state of the detecting unit 160 on the assumption that the continuous sheet P subjected to the measurement of the electrical resistance values is continuously being used. As compared with a configuration in which the measurement of the electrical resistance values is also performed during the detected state of the detecting unit 160 after the completion of the measurement of the electrical resistance values, therefore, the present exemplary embodiment reduces the frequency of measurement of the electrical resistance values by the measuring units 100 and 110.

Further, after the completion of the measurement by the measuring units 100 and 110, the measurement of the electrical resistance values by the measuring units 100 and 110 is performed again, if the detecting unit 160 detects, after an interruption of the detected state thereof, the disposed state of the continuous sheet P disposed on the transport path. Therefore, even if the continuous sheet P is replaced by another continuous sheet P having different electrical resistance values during the interruption of the detected state of the detecting unit 160 caused by power-off of the image forming apparatus 10, the electrical resistance values of the another continuous sheet P are known.

Further, the present exemplary embodiment uses the continuous sheet P previously disposed on the transport path, and thus allows the electrical resistance values to be measured on the transport path before the transport of the continuous sheet P. As compared with a configuration using a recording medium not previously disposed on the transport path, therefore, the present exemplary embodiment has a higher degree of freedom in disposing the measuring units 100 and 110. For example, therefore, the measuring units 100 and 110 may be disposed downstream of the transfer unit 35 in the sheet transport direction, or may be disposed at any position on the transport path on which the continuous sheet P is disposed.

Further, in the present exemplary embodiment, the pair of measuring units 100 and 110 are disposed between the reel-out roller 51 and the winding roller 52 on the transport path between the reel-out roller 51 and the transfer unit 35 (the second transfer position NT). For example, therefore, the electrical resistance values of the continuous sheet P may be measured when the continuous sheet P reeled out of the reel-out roller 51 is disposed on the transport path between the reel-out roller 51 and the winding roller 52 before being disposed up to the reel-in roller 53. In the case in which the electrical resistance values of the continuous sheet P are measured before the continuous sheet P reeled out of the reel-out roller 51 is disposed up to the reel-in roller 53, replacement work of the continuous sheet P based on the measurement results is facilitated as compared with a case in which the continuous sheet P is replaced after being disposed up to the reel-in roller 53.

First Modified Example of Measuring Units 100 and 110

Figure 4:
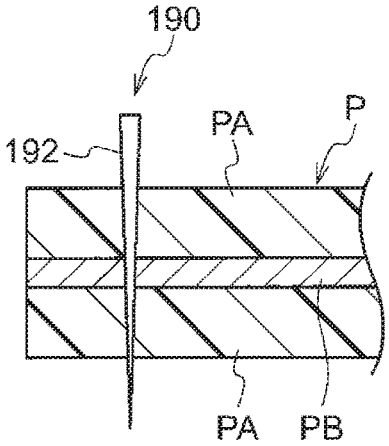
FIG. 4 is a schematic diagram illustrating a first modified example of the measuring units according to the first exemplary embodiment.

As illustrated in FIG. 4, a recording medium having a multilayer structure (three-layer structure) with resin films PA respectively forming the image surface and the non-image surface and a metal foil PB interposed between the resin films PA may be used as the continuous sheet P. In this case, the measuring units 100 and 110 are replaced by a measuring unit 190 that measures the electrical resistance value of the inside of the continuous sheet P in the direction crossing the thickness direction of the continuous sheet P before the voltage application by the transfer unit 35.

Figure 5:
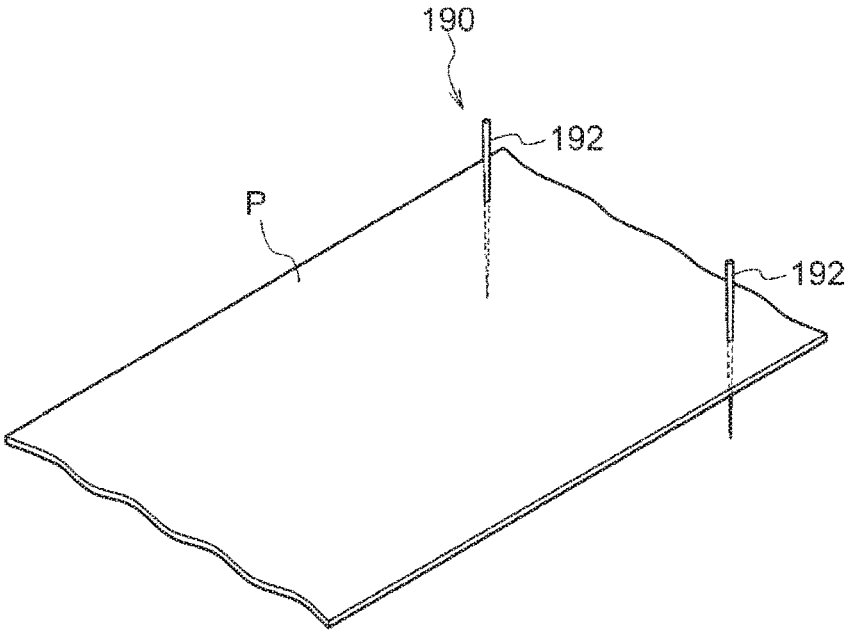
FIG. 5 is a perspective view illustrating the first modified example of the measuring units according to the first exemplary embodiment.

As illustrated in FIG. 5, the measuring unit 190 includes a pair of pins 192 (an example of through members) that pierce through the inside of the continuous sheet P in the thickness direction of the continuous sheet P. The pair of pins 192 are disposed along the width direction of the continuous sheet P on the upper side of the transport path of the continuous sheet P. The pair of pins 192 are configured to be movable between a piercing position at which the pair of pins 192 piece through the inside of the continuous sheet P in the thickness direction of the continuous sheet P from the image surface of the continuous sheet P and a separated position at which the pair of pins 192 are separated from the continuous sheet P. Specifically, at the piercing position, the pair of pins 192 are pierced through an area of the continuous sheet P other than a transfer area of the continuous sheet P in which the image is transferred. For example, as illustrated in FIG. 5, the pair of pins 192 are pierced through opposite end portions in the width direction of the continuous sheet P as the area other than the transfer area. The areas other than the transfer area may be the leading end portion (the downstream end portion in the sheet transport direction) of the continuous sheet P or the trailing end portion (the upstream end portion in the sheet transport direction) of the continuous sheet P. Further, the pair of pins 192 may be disposed along the sheet transport direction.

For example, the measuring unit 190 applies a voltage of a predetermined value between the pair of pins 192 pierced through the continuous sheet P, and detects the value of a current flowing between the pair of pins 192 in this case. Then, based on the applied voltage value and the detected current value, the measuring unit 190 measures the electrical resistance value of the inside of the continuous sheet P in the direction crossing the thickness direction of the continuous sheet P.

As described above, in the present first modified example, the measuring unit 190 measures the electrical resistance value of the inside of the continuous sheet P in the direction crossing the thickness direction of the continuous sheet P before the transfer unit 35 applies the voltage between the continuous sheet P and the toner images.

It is therefore known before the voltage application whether or not the voltage applied by the transfer unit 35 along the thickness direction of the continuous sheet P has an electrical resistance value that may cause a transfer failure due to a current flowing through the inside of the continuous sheet P in the direction crossing the thickness direction of the continuous sheet P.

Further, in the present first modified example, the pair of pins 192 are pierced through the area of the continuous sheet P other than the transfer area of the continuous sheet P in which the image is transferred. Therefore, the influence of piercing marks on the image is less than in a configuration that pierces the pair of pins 192 through the transfer area of the continuous sheet P.

Second Modified Example of Measuring Units 100 and 110

Figure 6:
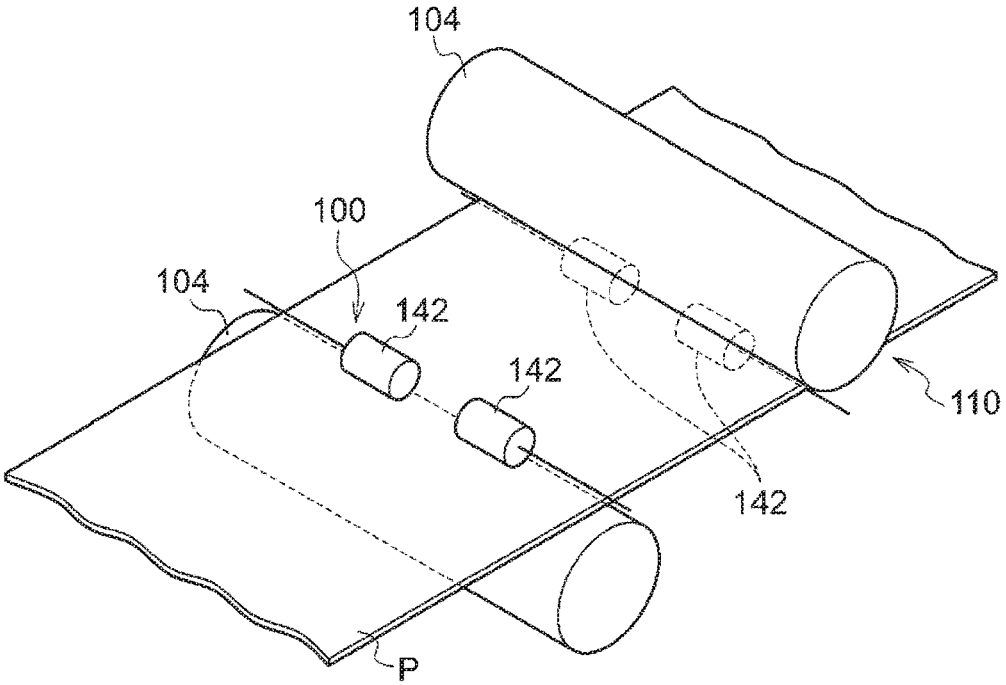
FIG. 6 is a perspective view illustrating a second modified example of the measuring units according to the first exemplary embodiment.

In a second modified example, each of the measuring units 100 and 110 includes a pair of measuring rollers 142 in place of the pair of terminals 102, as illustrated in FIG. 6. The measuring rollers 142 are constantly in contact with the image surface and the non-image surface of the continuous sheet P, and is rotated by the movement of the transported continuous sheet P. This configuration obviates the need for a mechanism that separates the measuring rollers 142 from the continuous sheet P.

Second Exemplary Embodiment

Image Forming Apparatus 200

Figure 7:
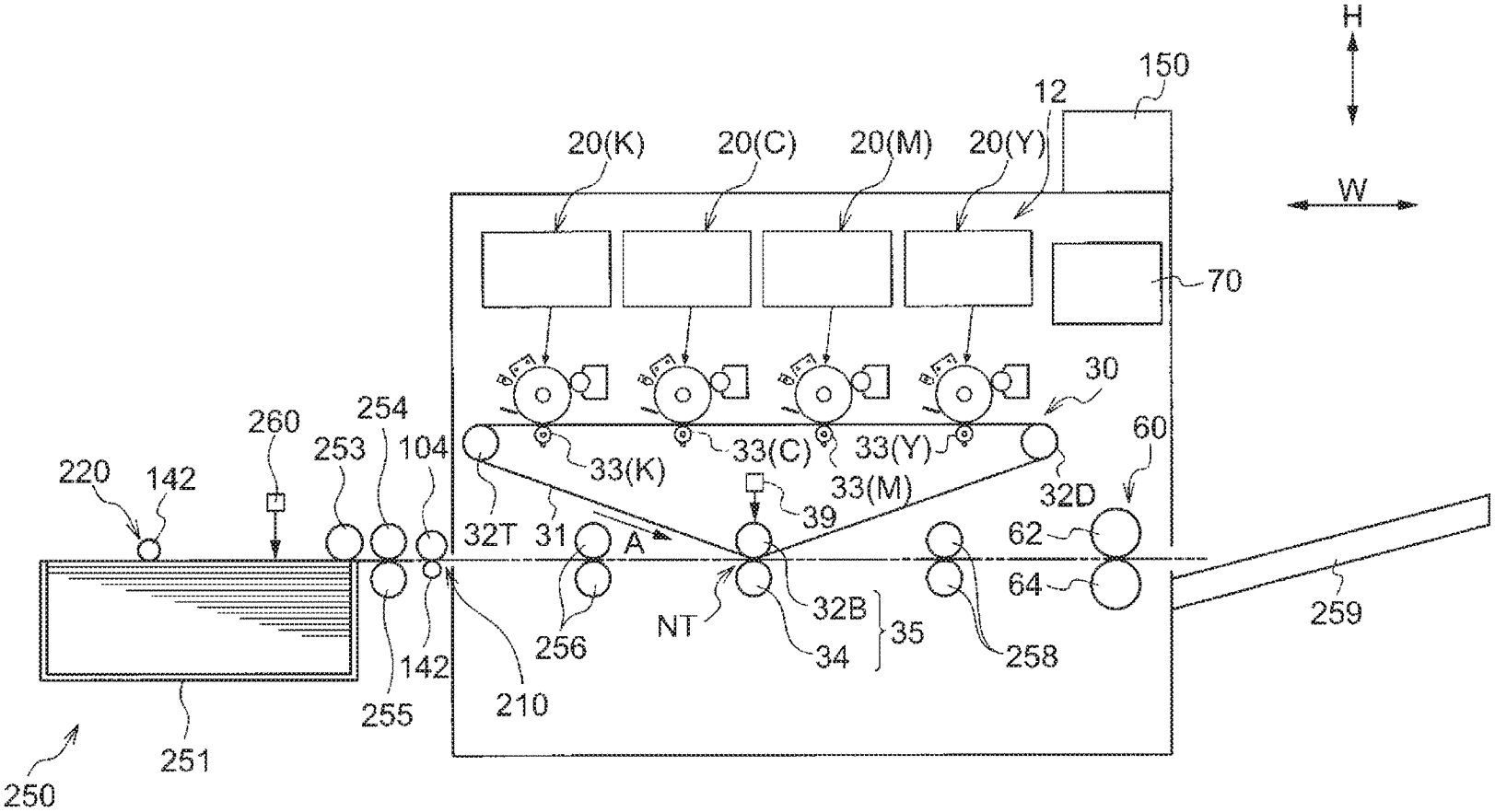
FIG. 7 is a schematic diagram illustrating a configuration of an image forming apparatus according to a second exemplary embodiment.

A configuration of an image forming apparatus 200 will now be described. FIG. 7 illustrates the configuration of the image forming apparatus 200 as viewed from a front side thereof. In the following, parts similar in function to those of the image forming apparatus 10 will be assigned with the same reference signs, and description thereof will be omitted as appropriate.

The image forming apparatus 200 is an apparatus that transports a cut sheet P2 (an example of the recording medium), which is disposed on a later-described disposing unit 251, in a predetermined transport direction (hereinafter referred to as the sheet transport direction) and forms an image on the cut sheet P2.

As illustrated in FIG. 7, the image forming apparatus 200 specifically includes a transport unit 250, the image forming unit 12, the fixing device 60, the controller 70, a pair of measuring units 220 and 210, the display 150, and a detecting unit 260.

Transport Unit 250

As illustrated in FIG. 7, the transport unit 250 includes the disposing unit 251 (an example of the supply unit), a feed roller 253, a transport roller 254, a multiple feeding preventing roller 255, transport roller pairs 256 and 258, and a discharge unit 259.

On the disposing unit 251, plural cut sheets P2 are disposed as stacked in the thickness direction thereof. The feed roller 253 comes into contact with the image surface (upper surface) of the uppermost one of the plural cut sheets P2 disposed on the disposing unit 251, and feeds the cut sheet P2 out of the disposing unit 251. The transport roller 254 comes into contact with the image surface of the cut sheet P2 fed by the feed roller 253, and transports the cut sheet P2 to the transfer unit 35 (the second transfer position NT). If plural cut sheets P2 are fed out of the disposing unit 251 in an overlapped manner, the multiple feeding preventing roller 255 prevents multiple feeding of the cut sheets P2 by applying a transport resistance to the lower one of the cut sheets P2.

The transport roller pair 256 is disposed between the transport roller 254 and the transfer unit 35 (the second transfer position NT). The transport roller pair 256 transports the cut sheet P2 transported from the transport roller 254 to the transfer unit 35 (the second transfer position NT). The transport roller pair 258 is disposed between the transfer unit 35 (the second transfer position NT) and the fixing device 60. The transport roller pair 258 transports the cut sheet P2 from the transfer unit 35 (the second transfer position NT) to the fixing device 60. The cut sheet P2 having the image fixed thereon by the fixing device 60 is discharged onto the discharge unit 259.

Pair of Measuring Units 220 and 210

The measuring unit 220 is a measuring unit that measures the electrical resistance value of the image surface of the cut sheet P2 in the direction crossing the thickness direction of the cut sheet P2 before the voltage application by the transfer unit 35. The measuring unit 220 specifically includes the pair of measuring rollers 142 in the foregoing second modified example. The pair of measuring rollers 142 are disposed on the upper side of the uppermost one of the plural cut sheets P2 disposed on the disposing unit 251 along the width direction of the cut sheet P2 (the depth direction of paper in FIG. 7).

For example, the measuring unit 220 applies a voltage of a predetermined value between the pair of measuring rollers 142, and detects the value of a current flowing between the pair of measuring rollers 142 in this case. Then, based on the applied voltage value and the detected current value, the measuring unit 220 measures the electrical resistance value of the image surface of the cut sheet P2 in the direction crossing the thickness direction of the cut sheet P2.

The measuring unit 210 is a measuring unit that measures the electrical resistance value of the non-image surface of the cut sheet P2 in the direction crossing the thickness direction of the cut sheet P2. For example, the measuring unit 210 is disposed downstream of the transport roller 254 and the multiple feeding preventing roller 255 in the sheet transport direction. Similarly to the measuring unit 110 in the foregoing second modified example, the measuring unit 210 includes the facing roller 104 and the pair of measuring rollers 142.

For example, the measuring unit 210 also applies a voltage of a predetermined value between the pair of measuring rollers 142, and detects the value of a current flowing between the pair of measuring rollers 142 in this case. Then, based on the applied voltage value and the detected current value, the measuring unit 210 measures the electrical resistance value of the non-image surface of the cut sheet P2 in the direction crossing the thickness direction of the cut sheet P2. The measurement by the measuring unit 210 is performed with the cut sheet P2 fed out of the disposing unit 251 to and stopped at a position at which a leading end portion of the cut sheet P2 is held between the facing roller 104 and the pair of measuring rollers 142, for example.

Detecting Unit 260

The detecting unit 260 has a function of detecting a disposed state in which the cut sheet P2 is disposed on the disposing unit 251, and maintaining a detected state in which the disposed state is detected. For example, the detecting unit 260 is disposed above the disposing unit 251, as illustrated in FIG. 7. An optical sensor or a switch that turns on by contact with the cut sheet P2, for example, is used as the detecting unit 260.

For example, if an optical sensor is used as the detecting unit 260, the detecting unit 260 radiates light onto the disposing unit 251, and detects the disposed state of the cut sheet P2 disposed on the disposing unit 251 when the light is blocked by the cut sheet P2 disposed on the disposing unit 251. The detecting unit 260 further continuously radiates the light from the optical sensor to maintain the detected state in which the disposed state of the cut sheet P2 is detected.

Controller 70

The controller 70 is connected to the pair of measuring units 220 and 210. Thereby, measurement results of the pair of measuring units 220 and 210 are transmitted to the controller 70 from the pair of measuring units 220 and 210. The controller 70 is further connected to the detecting unit 260. Thereby, a detection result of the detecting unit 260 is transmitted to the controller 70 from the detecting unit 260.

Based on the detection result of the detecting unit 260 and the measurement results of the pair of measuring units 220 and 210, the controller 70 controls operations of respective units of the image forming apparatus 200 including the voltage applying unit 39 and the display 150. The operations of the respective units controlled by the controller 70 will be described in a subsequent description of operations.

Operations

In the present exemplary embodiment, if the image forming apparatus 200 is powered on, the detecting unit 260 detects the disposed state of the cut sheet P2 disposed on the disposing unit 251. After the detecting unit 260 detects the disposed state and before an image forming operation is executed, the pair of measuring units 220 and 210 measure the respective electrical resistance values of the image surface and the non-image surface of the cut sheet P2 in the direction crossing the thickness direction of the cut sheet P2. That is, the respective electrical resistance values of the image surface and the non-image surface of the cut sheet P2 are measured before the transfer unit 35 applies the voltage between the cut sheet P2 and the toner images.

The measurement of the non-image surface of the cut sheet P2 by the measuring unit 210 is performed with the cut sheet P2 fed out of the disposing unit 251 to and stopped at the position at which the leading end portion of the cut sheet P2 is held between the facing roller 104 and the pair of measuring rollers 142, for example.

If at least one of the electrical resistance values measured on the image surface and the non-image surface of the cut sheet P2 is equal to or lower than a predetermined reference resistance value, the controller 70 controls the operations of the respective units as follows. That is, the display 150 displays a warning that the set cut sheet P2 is exempt from quality warranty, for example. The warning to be displayed may be a message that an image defect may occur or a message prompting replacement of the cut sheet P2, for example.

In place of or in addition to the above-described display of the warning, the transfer operation of the transfer device 30 (the voltage applying operation of the voltage applying unit 39) or the operation of the entire image forming apparatus 200 including the transport unit 250, the image forming unit 12, and the fixing device 60 may be prevented from being executed. Further, the display of the warning and the suspension of the operation described above may be replaced by a configuration that reduces the value of the voltage to be applied by the voltage applying unit 39.

If any of the electrical resistance values measured on the image surface and the non-image surface of the cut sheet P2 exceeds the predetermined reference resistance value, a start-up operation of the image forming apparatus 200 is performed to make the image forming apparatus 200 capable of executing the image formation. Then, after the completion of the measurement by the measuring units 220 and 210, the measurement of the electrical resistance values by the measuring units 220 and 210 is not performed during the detected state of the detecting unit 260 on the assumption that the cut sheet P2 of the same type is being used.

Further, after the completion of the measurement by the measuring units 220 and 210, the measurement of the electrical resistance values by the measuring units 220 and 210 is performed again, if the detecting unit 260 detects, after an interruption of the detected state thereof, the disposed state of the cut sheet P2 disposed on the disposing unit 251. The detected state of the detecting unit 260 may be interrupted when, for example, the cut sheet P2 is replaced, the image forming apparatus 200 is powered off, or the image forming apparatus 200 shifts to a standby state (sleep mode) because of not being used for an extended time, for example.

The second exemplary embodiment also has operations and effects similar to those of the first exemplary embodiment. That is, in the second exemplary embodiment, the pair of measuring units 220 and 210 measure the respective electrical resistance values of the image surface and the non-image surface of the cut sheet P2 in the direction crossing the thickness direction of the cut sheet P2 before the execution of the image forming operation (before the voltage application by the transfer unit 35).

It is therefore known before the voltage application whether or not the voltage applied by the transfer unit 35 along the thickness direction of the cut sheet P2 has an electrical resistance value that may cause a transfer failure due to a current flowing through the image surface and the non-image surface of the cut sheet P2 in the direction crossing the thickness direction of the cut sheet P2.

Further, in the present exemplary embodiment, if any of the electrical resistance values measured on the image surface and the non-image surface of the cut sheet P2 is equal to or lower than the predetermined reference resistance value, the warning is displayed, and/or the operation of the image forming apparatus 200 is limited. In the image surface and the non-image surface of the cut sheet P2, therefore, a current flow in the direction crossing the thickness direction of the cut sheet P2 is suppressed. Thereby, the transfer failure due to, for example, scattering of the toners of the toner images transferred to the cut sheet P2 from the transfer belt 31 is suppressed.

In the second exemplary embodiment, the electrical resistance values may be measured for each of the plural cut sheets P2 disposed on the disposing unit 251. In this configuration, even if plural cut sheets P2 of different electrical resistance values are disposed on the disposing unit 251, the electrical resistance values of each of the cut sheets P2 are known.

Further, the second exemplary embodiment may also use a measuring unit including the pair of terminals 102 and the facing roller 104 or the foregoing measuring unit including the pair of pins 192 that pierce through the inside of the cut sheet P2 in the thickness direction of the cut sheet P2.

Other Modified Examples

In the foregoing first and second exemplary embodiments, the measuring units 100, 110, 190, 220, and 210 apply the voltage of a predetermined value between two points, and measure the electrical resistance value from the value of the current flowing between the two points in this case. However, the configuration is not limited thereto. For example, a configuration may flow a current between two points and measure a resistance from the value of a voltage detected in this case. Another configuration may generate an overcurrent in the measurement target by providing coils in the measuring terminals, and measure a resistance value from an electric field generated by the overcurrent. That is, the measuring units of the present exemplary embodiments may employ any measurement principle.

The present invention is not limited to the above-described exemplary embodiments, and may be modified, altered, or improved in various ways within a scope not deviating from the gist of the invention. For example, two or more of the foregoing modified examples may be combined as appropriate to form another configuration.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a transfer unit configured to transfer an image onto at least one recording medium by applying a voltage between the at least one recording medium and the image along a thickness direction of the at least one recording medium; and a pair of measuring units configured to, before the transfer unit applies the voltage, measure respective electrical resistance values of a front surface and a rear surface of the at least one recording medium in a direction crossing the thickness direction, wherein one of the pair of measuring units is configured to measure an electrical resistance value of a front surface and another of the pair of measuring units is configured to measure an electrical resistance value of a rear surface, and wherein the one of the pair of measuring units and the another of the pair of measuring units are disposed in different places along a transport direction of the at least one recording medium.

2. The image forming apparatus according to claim 1, wherein the pair of measuring units are configured to measure the respective electrical resistance values of the front surface and the rear surface of the at least one recording medium in the direction crossing the thickness direction at different times.

3. The image forming apparatus according to claim 2, wherein a first one of the pair of measuring units is configured to measure an electrical resistance value of one of the front surface and the rear surface of the at least one recording medium with the first one of the pair of measuring units kept in contact with the one of the front surface and the rear surface, with a second one of the pair of measuring units separated from the at least one recording medium.

4. The image forming apparatus according to claim 1, further comprising:

a supply unit configured to supply the at least one recording medium to the transfer unit; and a detecting unit configured to detect a disposed state in which the at least one recording medium is disposed on the supply unit or a transport path, and configured to maintain a detected state in which the disposed state is detected, wherein the pair of measuring units are configured to measure the electrical resistance values after the detection of the disposed state by the detecting unit, and are configured to refrain from measuring the electrical resistance values during the detected state of the detecting unit after completion of the measurement.

5. The image forming apparatus according to claim 4, wherein the pair of measuring units are configured to measure the electrical resistance values after the detection of the disposed state by the detecting unit, and are configured to measure the electrical resistance values again after the completion of the measurement if the detecting unit detects the disposed state after an interruption of the detected state of the detecting unit.

6. The image forming apparatus according to claim 1, wherein the at least one recording medium includes a plurality of recording media disposed on a supply unit configured to supply the plurality of recording media to the transfer unit, and wherein the pair of measuring units are configured to measure the electrical resistance values of each of the plurality of recording media.

7. The image forming apparatus according to claim 1, wherein the image forming apparatus is configured to transport the at least one recording medium after previously being disposed on a transport path.

8. The image forming apparatus according to claim 7, wherein the pair of measuring units are disposed on the transport path between the transfer unit and a supply unit configured to supply the at least one recording medium to the transfer unit.

9. The image forming apparatus according to claim 8, wherein the pair of measuring units are disposed on the transport path between the supply unit and a winding member which is disposed between the supply unit and the transfer unit at a position closest to the supply unit, and around which the at least one recording medium is wound.

10. The image forming apparatus according to claim 1, further comprising:

a display configured to display an item to be notified to a user of the image forming apparatus; and a controller configured to control operations of the display as the display displays a warning if at least one of the electrical resistance value measured on the front surface and the electrical resistance value measured on the rear surface is equal to or lower than a predetermined reference resistance value.

11. An image forming apparatus comprising:

a transfer unit configured to transfer an image onto at least one recording medium by applying a voltage between the at least one recording medium and the image along a thickness direction of the at least one recording medium; and a measuring unit configured to, before the transfer unit applies the voltage, measure an electrical resistance value of an inside of the at least one recording medium in a direction crossing the thickness direction, wherein the measuring unit is configured to measure the electrical resistance value with through members pierced completely through the at least one recording medium in the thickness direction in an area of the at least one recording medium other than a transfer area of the at least one recording medium in which the image is transferred, and wherein, the through members are disposed in different places along a width direction of the at least one recording medium or in different places along a transport direction of the at least one recording medium.

12. The image forming apparatus according to claim 11, further comprising:

a supply unit configured to supply the at least one recording medium to the transfer unit; and a detecting unit configured to detect a disposed state in which the at least one recording medium is disposed on the supply unit or a transport path, and configured to maintain a detected state in which the disposed state is detected, wherein the measuring unit is configured to measure the electrical resistance value after the detection of the disposed state by the detecting unit, and is configured to refrain front measuring the electrical resistance value during the detected state of the detecting unit after completion of the measurement.

13. The image forming apparatus according to claim 12, wherein the measuring unit is configured to measure the electrical resistance value after the detection of the disposed state by the detecting unit, and is configured to measure the electrical resistance value again after the completion of the measurement if the detecting unit detects the disposed state after an interruption of the detected state of the detecting unit.

14. The image forming apparatus according to claim 11, wherein the at least one recording medium includes a plurality of recording media disposed on a supply unit configured to supply the plurality of recording media to the transfer unit, and wherein the measuring unit is configured to measure the electrical resistance value of each of the plurality of recording media.

15. The image forming apparatus according to claim 11, wherein the image forming apparatus is configured to transport the at least one recording medium after previously being disposed on a transport path.

16. The image forming apparatus according to claim 15, wherein the measuring unit is disposed on the transport path between the transfer unit and a supply unit configured to supply the at least one recording medium to the transfer unit.

17. The image forming apparatus according to claim 16, wherein the measuring unit is disposed on the transport path between the supply unit and a winding member which is disposed between the supply unit and the transfer unit at a position closest to the supply unit, and around which the at least one recording medium is wound.

18. An image forming method comprising:

measuring respective electrical resistance values of a front surface and a rear surface of at least one recording medium in a direction crossing a thickness direction of the at least one recording medium; and transferring an image onto the at least one recording medium by applying a voltage between the at least one recording medium and the image along the thickness direction, wherein the measuring comprises measuring an electrical resistance value of a front surface and measuring an electrical resistance value of a rear surface at different places along a transport direction of the at least one recording medium.

* * * * *